US011842848B1

(12) United States Patent
Werbelow

(10) Patent No.: US 11,842,848 B1
(45) Date of Patent: Dec. 12, 2023

(54) DECORATIVE MAGNETIC COVER AND METHOD OF MANUFACTURE

(71) Applicant: Eric Werbelow, Sarasotaa, FL (US)

(72) Inventor: Eric Werbelow, Sarasotaa, FL (US)

( * ) Notice: Subject to any disclaimer, the term of this patent is extended or adjusted under 35 U.S.C. 154(b) by 20 days.

(21) Appl. No.: 17/747,179

(22) Filed: May 18, 2022

Related U.S. Application Data

(60) Provisional application No. 63/190,076, filed on May 18, 2021.

(51) Int. Cl.
*H01F 7/02* (2006.01)

(52) U.S. Cl.
CPC ..... *H01F 7/02* (2013.01)

(58) Field of Classification Search
CPC ..... H01F 7/02
See application file for complete search history.

(56) References Cited

U.S. PATENT DOCUMENTS

| | | | | |
|---|---|---|---|---|
| 3,746,992 | A * | 7/1973 | Serembe | B43L 5/022 33/DIG. 1 |
| 5,858,514 | A | 1/1999 | Bowers | |
| 6,052,933 | A * | 4/2000 | Lytle | G09F 1/12 40/594 |
| 8,440,128 | B2 | 5/2013 | Love | |
| 9,346,307 | B2 | 5/2016 | Schleicher, Jr. | |
| 9,440,480 | B1 | 9/2016 | Lefevre et al. | |
| 9,925,699 | B2 | 3/2018 | Schleicher, Jr. | |
| 10,398,047 | B2 | 8/2019 | Thompson | |
| 2006/0166026 | A1 | 3/2006 | Boudouris et al. | |
| 2009/0263634 | A1 | 10/2009 | Hyer et al. | |
| 2010/0313508 | A1 | 12/2010 | Anders | |
| 2011/0139860 | A1 | 6/2011 | Mueller | |
| 2012/0279157 | A1 | 3/2012 | Sha | |

FOREIGN PATENT DOCUMENTS

| | | | | |
|---|---|---|---|---|
| CN | 112466588 A | * | 3/2021 | B25B 11/002 |
| DE | 3411788 A | * | 10/1984 | B24D 1/06 |
| GB | 2345245 A | * | 7/2000 | A47G 1/0633 |
| KR | 20070067979 A | * | 6/2007 | |
| WO | WO-2015002484 A1 | * | 1/2015 | B65G 54/02 |

* cited by examiner

*Primary Examiner* — Mohamad A Musleh
(74) *Attorney, Agent, or Firm* — Bryan L. Loeffler, Esq.; LOEFFLER IP GROUP, P.A.

(57) ABSTRACT

A decorative magnetic cover for use in attachment to a non-metallic surface such as window or screen is provided. The decorative magnetic cover includes a magnetized first half and a magnetized second half shaped substantially identical to the magnetized first half. Imprints are formed on outer surfaces of the first and second halves. There is also disclosed a method of forming a magnetic cover such that an inner surface of a first half of the magnetic cover has a first polarity and an inner surface of a second half of the magnetic cover has a second polarity opposite the first polarity to hold the magnetized first and second halve together about a surface.

1 Claim, 6 Drawing Sheets

DECORATIVE MAGNETIC COVER AND METHOD OF MANUFACTURE

CROSS-REFERENCE TO RELATED APPLICATION

This application claims priority to application No. 63/190,076, filed on May 18, 2021, which is currently pending. The patent application identified above is incorporated herein by reference in its entirety to provide continuity of disclosure.

FIELD OF THE INVENTION

The present invention relates generally to decorative coverings, and more particularly, to a decorative magnetic cover for use on a surface such as a screen and a method of manufacturing the decorative magnetic cover.

BACKGROUND OF THE INVENTION

It is often desirable to affix coverings or devices to various surfaces for the purposes of decoration and/or safety, for example, various decorative magnetic coverings are often applied to blank or bland metallic surfaces, such as refrigerators, cars, trucks, and so forth.

Similarly, decals and other signs are often applied to clear door glass to prevent individuals from accidentally walking into or through the glass door. Most often, these types of signs are attached by an adhesive or with a mechanical attachment, such as a hook and suction cup.

These conventional attachment methods of adhesives and mechanical fasteners are not usable on screen and/or will damage the screen if removed. In addition, conventional magnetic decorations require a metallic substrate to adhere to. Thus, they are also unsuitable for use on screen doors and screened enclosures.

Therefore, a need exists for a decorative cover that is removably attachable to a mesh screen or similar non-metallic surface.

SUMMARY OF THE INVENTION

The present invention is directed to a decorative magnetic cover for use in attachment to a non-metallic surface such as window or screen. The decorative magnetic cover includes a magnetized first half and a magnetized second half shaped substantially identical to the magnetized first half. Decorative and/or informational imprints are formed on outer surfaces of the first and second halves. There is also disclosed a method of forming a magnetic cover such that an inner surface of a first half of the magnetic cover has a first polarity and an inner surface of a second half of the magnetic cover has a second polarity opposite the first polarity to join or hold the magnetized first and second halves together about a surface.

In a first implementation of the invention, a magnetic cover for application to opposed sides of a non-metallic surface is provided, the magnetic cover having a magnetized first half having a first inner surface and a first outer surface, said first half being formed from a sheet of magnetic material such that said first inner surface has a first polarity and said first outer surface has a second polarity opposite said first polarity; a magnetized second half having a second inner surface and a second outer surface, said second half being formed from a sheet of magnetic material such that said second inner surface of said second half has an opposite polarity from said first polarity of said first inner surface of said first half; and an imprint formed on at least one of said first and second outer surfaces of said first and second halves.

In a second aspect, a first imprint is formed on the first outer surface of the first half.

In another aspect, a second imprint is formed on the second outer surface of the second half.

In another aspect, the first half has a first peripheral edge and the second half has a second peripheral edge.

In another aspect, the first peripheral edge of the first half is substantially identical to the second peripheral edge of the second half.

In another aspect, the imprint formed on the first half has a color.

In another aspect, the imprint formed on the first half has multiple differing colors.

In another implementation of the invention, a method of forming a magnetic cover for use on non-metallic surfaces is provided, the method having steps of providing a sheet of magnetized material having a first side with a first polarity and a second side with a second polarity; cutting a first half of a magnetic cover from said sheet of magnetized material such that an inner surface of said first half has said first polarity and an outer surface of said first half has said second polarity; cutting a second half of said magnetic cover from said sheet of magnetized material such that an inner surface of said second half has said second polarity and an outer surface of said second half has said first polarity; and forming an imprint on at least one of said first and second outer surfaces of said first and second halves.

In a second aspect, the step of forming an imprint includes forming an imprint on at least one of said first and second outer surfaces with a thermal printer.

In another aspect, the step of forming an imprint includes forming an imprint on at least one of said first and second outer surfaces with a piezoelectric printer.

In another aspect, the step of foiling an imprint includes forming an imprint on at least one of said first and second outer surfaces with a latex printer.

In another aspect, the step of forming an imprint include forming a first imprint on the outer surface of the first half and forming and second imprint on the outer surface of the second half.

In another aspect, the step of forming an imprint includes forming an imprint on the outer surface of the second half identical to the imprint formed on the outer surface of the first half.

In another aspect, the step of cutting a second half of said magnetic cover include cutting the second half such that an outer periphery of second half is substantially identical to an outer periphery of said first half.

In yet another implementation of the invention, a method of affixing a magnetic cover on non-metallic surfaces is provided, the method having steps of: providing a magnetic cover the magnetic cover including a magnetized first half having a first inner surface and a first outer surface, said first half being formed from a sheet of magnetic material such that said first inner surface has a first polarity and said first outer surface has a second polarity opposite said first polarity; and a magnetized second half having a second inner surface and a second outer surface, said second half being formed from a sheet of magnetic material such that said second inner surface of said second half has an opposite polarity from said first polarity of said first inner surface of said first half; positioning said magnetized first half adjacent a first side of a non-metallic surface; positioning said magnetized second half adjacent a second side of a non-metallic surface; and moving said magnetized first and second surfaces toward each other such that said first polarity of said first inner surface of said magnetized first half is attracted to said second polarity of said second inner surface of said magnetized second half to secure said magnetized first half against said magnetized second half and about the non-metallic surface.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward an easily removable and movable decorative magnetic cover that can be attached to a surface for aesthetic or safety purposes and a method of manufacturing the decorative magnetic cover.

Figure 1:
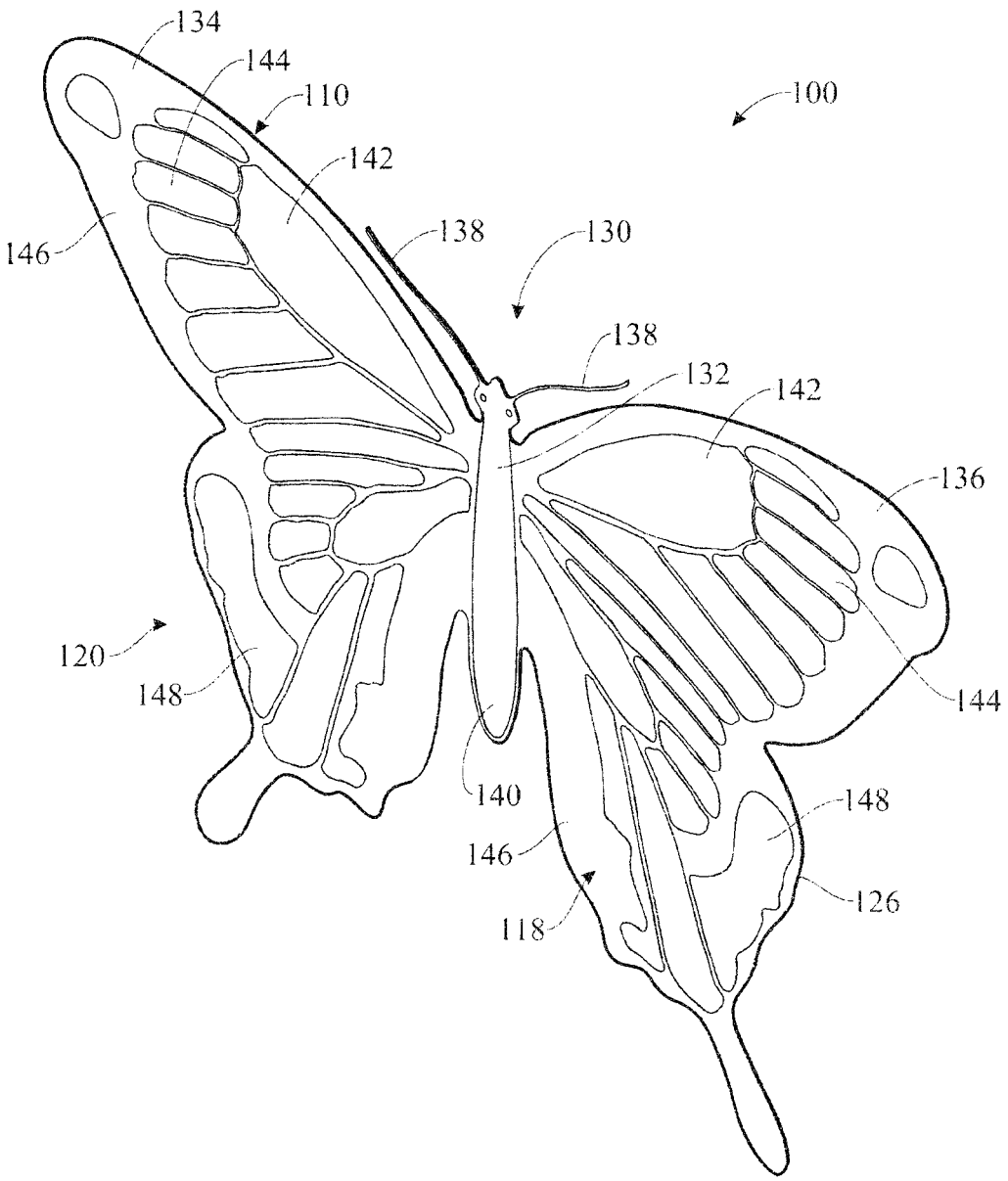
FIG. 1 presents a perspective view of a decorative magnetic cover for use on a screen in accordance with a first illustrative embodiment of the present invention.
Figure 2:
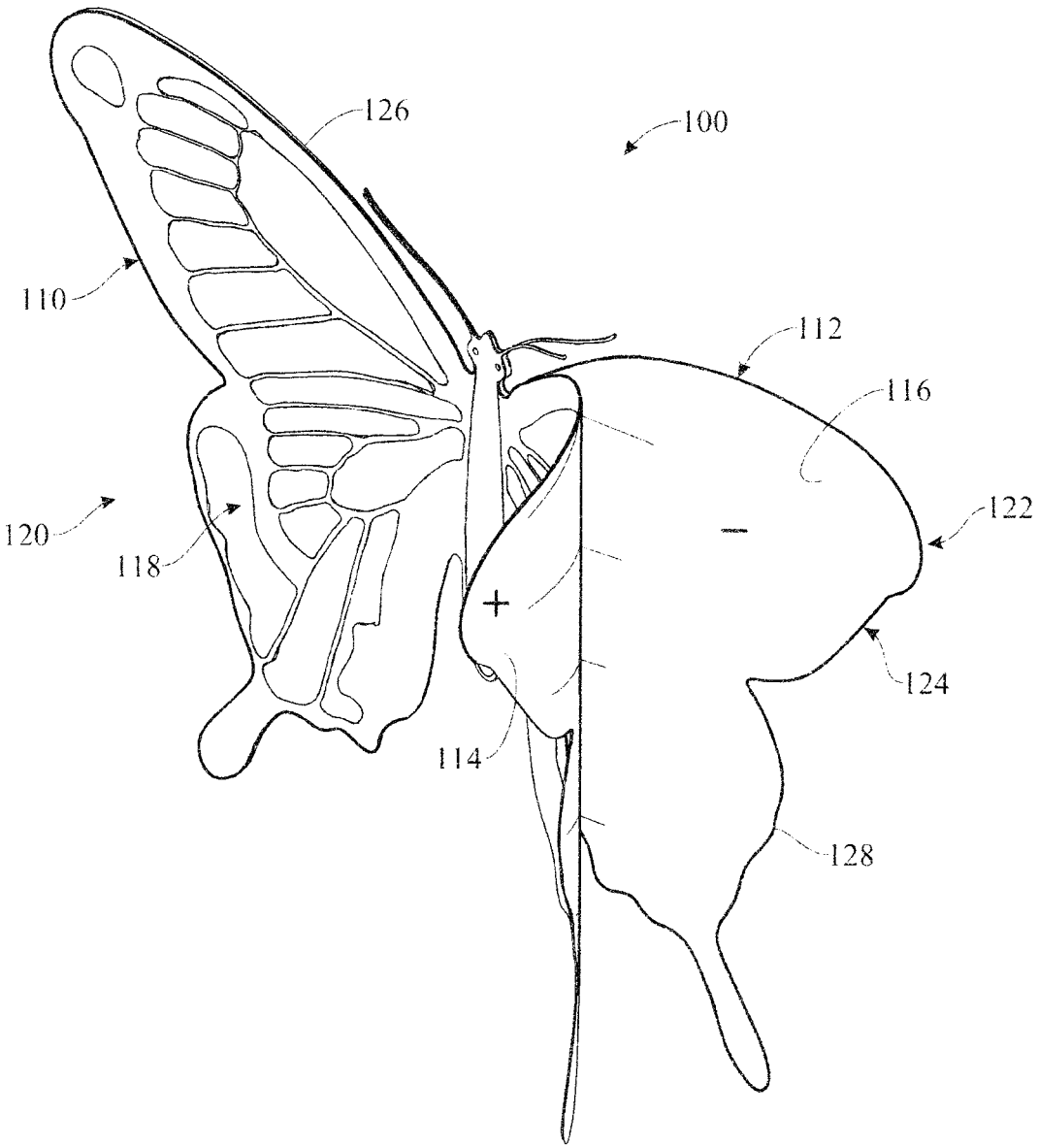
FIG. 2 presents a perspective view of the decorative magnetic cover illustrated in FIG. 1 with front and back covering halves partially separated.
Figure 3:
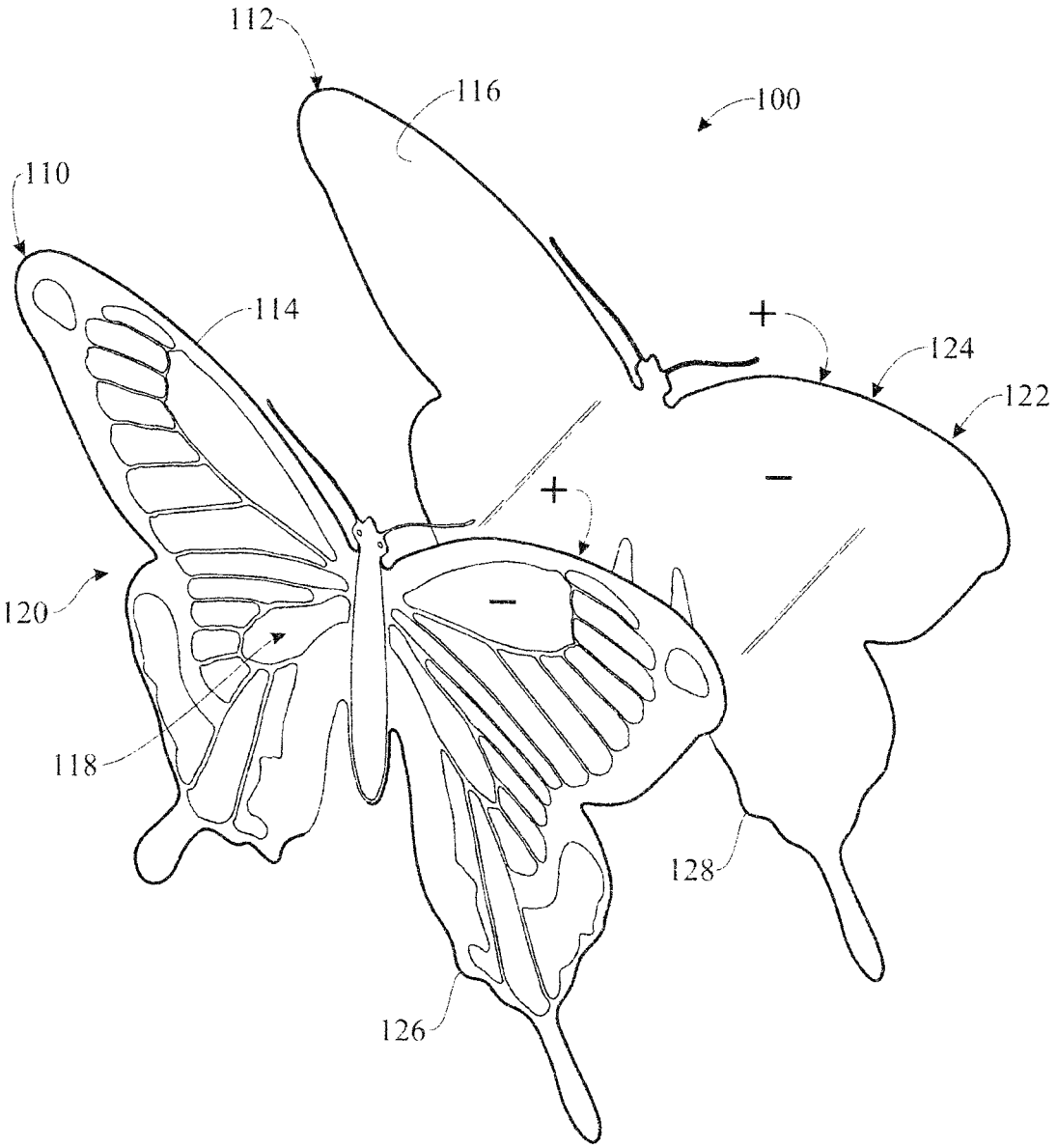
FIG. 3 presents a perspective view of the decorative magnetic cover illustrated in FIG. 2, with the front and back covering halves fully separated for attachment about a screen.

Referring to FIGS. 1-5, and initially with regard to FIGS. 1-3, a decorative magnetic cover for use on a surface of a screen, window, fence, etc., hereinafter decorative cover 100, is illustrated in accordance with a first exemplary embodiment of the present invention. As shown, the decorative cover 100 generally includes a magnetized first half 110 and a magnetized second half 112 which is magnetically attracted to the magnetized first half 110 so as to removably affix the decorative cover 100 to a non-magnetic surface such as, for example, a window or screen. The magnetized first half 110 has a first inner face or surface 114 which, in use, is magnetically attracted or connected to a second inner face or surface 116 of the magnetized second half 112. Thus, the magnetized first and second halves 110 and 112, respectively, of the decorative cover 100 clamp together about the non-magnetic surface to support and attach the decorative cover 100 to the non-magnetic surface as discussed in more detail hereinbelow.

As shown, the magnetized first half 110 has a first outer face or surface 118 presenting a first image 120 on the first outer surface 118. While not specifically shown, a second image 122 is presented on a second outer face or surface 124 of the magnetized second half 112 (FIGS. 2 and 3). The first and second images 120 and 122 may be identical, similar or dissimilar as desired.

In addition to having first and second images 120 and 122, respectively, on the magnetized first and second halves 110 and 112, the decorative cover 100 is formed with a particular shape suitable to the images, such as first and second images 120 and 122, respectively. Thus, as discussed in more detail hereinbelow, the magnetized first half 110 is formed with and has a specifically shaped first peripheral edge 126 and the magnetized second half 112 is formed with and has a mirror image second peripheral edge 128 identical to the first peripheral edge 126 of the magnetized first half 110. Thus, the overall shapes of the magnetized first and second halves 110 and 112 are identical mirror images of each other.

Referring for the moment to FIG. 1, as noted hereinabove, the decorative magnetic cover 100 may be provided in a variety of shapes and images. As shown, in the first exemplary embodiment of the decorative cover 100, the decorative cover 100 is formed in the shape and image of a butterfly 130 having a shape and image of a body portion 132, a first wing 134 and a second wing 136. Appendages 138 may be formed on one or both of the magnetized first and second halves 110 and 112.

The first image 120 of the butterfly 130 may be provided with a variety of colors, patterns, or sub-images to simulate the appearance of a butterfly. For example, the first image 120 may have a first color, image or pattern 140 on the body portion 132. The first and second wings 134 and 136, respectively, may also be provided with a variety of colors or images presented on the first outer surface 118 of the magnetized first half 110. Thus, a second, third, fourth, fifth, etc. colors, images or multi-color images 142, 144, 146, 148, etc. respectively, may be presented on the first outer surface 118 to provide a depiction of the butterfly 130. It should be noted that, while not specifically shown, the second image 122 on the second outer surface 124 of the magnetized second half 112 of the decorative cover 100 may include similar, identical, or dissimilar colors, image and/or multi-color images of an identical or similar image of a butterfly.

Additionally, while also not specifically shown, the first and second inner surfaces 114 and 116 of the magnetized first and second halves 110 and 112, respectively, of the decorative cover 100 may be provided with images, colors or patterns differing from those presented on the first and second outer surfaces 118 and 124. This provides an alternative and removable image on the decorative cover 100. The magnetized first and second halves 110 and 112 may be reversed such that the first and second halves 110 and 112 may be affixed to the desired window or screen with the first and second outer surfaces 118 and 124 facing inward towards the window or screen and each other and the first and second inner surfaces 114 and 116 face outwards to present the images (not shown) presented on those surfaces. This gives the user the option of two alternative images on the same decorative cover 100.

The decorative cover 100, including the magnetized first and second halves 110 and 112, respectively, is formed from one or more sheets of flexible and pre-magnetized material having sufficient magnetic strength to hold the magnetized first and second halves 110 and 112 together about a surface such as a window or screen. Additionally, the material chosen for the magnetized first and second halves is such that images, colors and/or patterns can be imprinted or otherwise imparted to the material.

One such suitable material for use in forming the decorative cover 100 is MuscleMag® Latex High Energy Magnetic Sheeting for Latex Printers available from Magnum Magnetics®. This material is suitable for use with various latex printers and is rated for outdoor use. The MuscleMag® sheeting has a minimum magnetic pull strength of 65 lbs/ft$^2$ and has sufficient strength to be used out of doors. The shapes of the first and second halves 110 and 112 may be formed before or after imparting the desired images, colors and/or patterns on the sheet of material. The images, colors and/or patterns can be imparted to the material by thermo, piezoelectric, flatbed or latex printing and may be formed with a gloss or matt finish.

In order to impart the desired shape to the material, the material may be cut using various types of sheet material cutting devices. In a preferred method a counter cutter is utilized to cut the sheet of magnetized material to the desired shape.

Turning now specifically to FIGS. 2 and 3, it should be noted that magnetized material is polarized, i.e., one side of the material has one charge or polarity while the opposite side of the material has an opposite charge or polarity. This fact does not need to be addressed when a single sheet of magnetized material is attached to a metallic material such as, for example, a refrigerator, a car door, etc. The fact that the sheet of magnetized material is polarized is a consideration when designing the magnetized first and second halves 110 and 112 of the decorative cover 100 since opposite polarities attract each other while same polarities repel each other. In order for the magnetized first and second halves 110 and 112 of the decorative cover to attract and hold each other, the first and second inner surfaces 114 and 116 must have opposite polarities.

Thus, for example, if the first inner surface 114 of the magnetized first half 110 has a positive polarity (+) then the magnetized second half 112 of the decorative cover 100 must be formed such that the second inner surface 116 has a negative polarity (−) as shown. This ensures that the magnetized first half 110 and the magnetized second half 112 are attracted to each other to secure the decorative cover 100 about the desired surface. It is a given then, that since the first and second outer surfaces 118 and 124 have opposite polarities to the respective first and second inner surfaces 114 and 116, i.e., the first outer surface 118 would have a negative (−) polarity and the second outer surface 124 would have a positive (+) polarity.

Therefore, when printing the desired images, colors and/or patterns on the first and second halves 110 and 112 of the decorative cover 100 from the same sheet of material, the desired imprint on the first outer surface 118 of the magnetized first half 110 is printed on one side of the sheet of magnetized material while the similar desired imprint on the second outer surface 124 is printed on the opposite side of the magnetized material to ensure the polarities are correct. This ensures that the first outer surface 118 of the magnetized first half 110 has one polarity and the second outer surface 124 of the magnetized second half 112 has the opposite polarity. The first and second inner surfaces 114 and 116 of the magnetized first and second halves 110 and 112 have the opposite polarities to ensure they attract each other as noted hereinabove.

Figure 4:
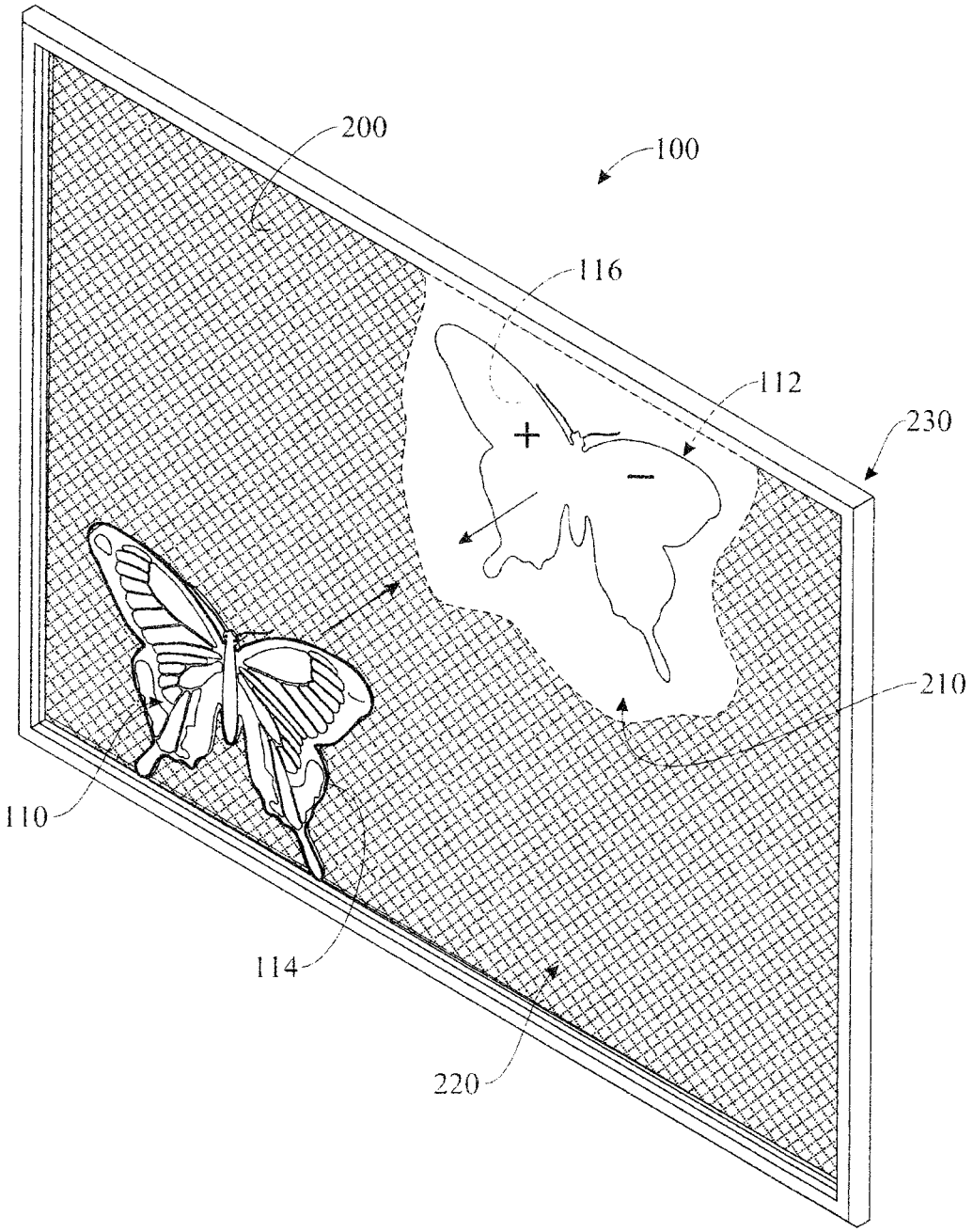
FIG. 4 presents an isometric view of the separated front and back covering halves positioned about a screen prior to attachment about the screen.
Figure 5:
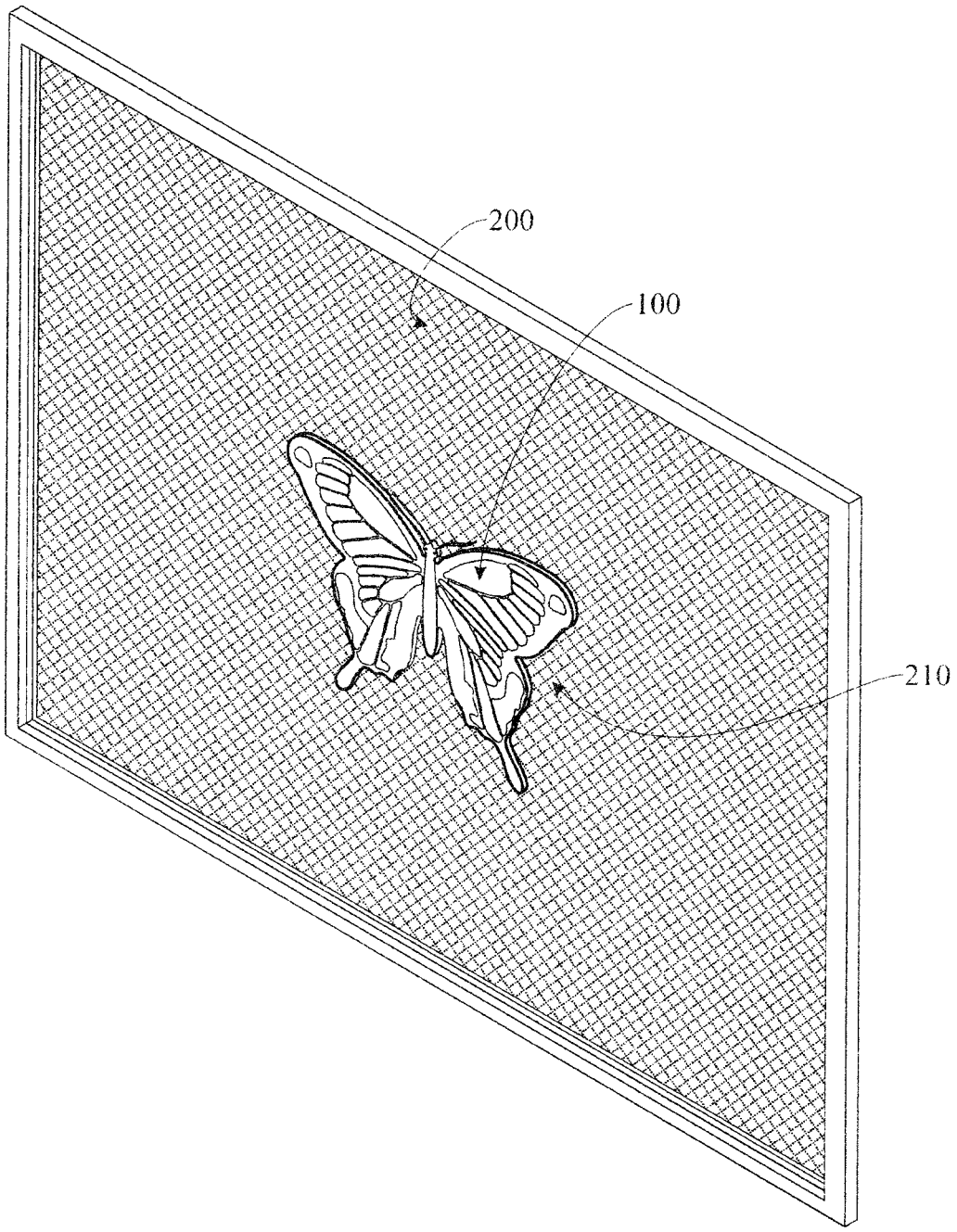
FIG. 5 presents an isometric front view of the decorative magnetic cover attached about the screen.

Turning now to FIGS. 4-5, in use, the decorative cover 100 is provided for use in decorating and providing a safety signal or indicator on a non-metallic surface that cannot hold a magnetized material or has a minimal amount of metal that will not support the magnetized material on only one side, for example, window screen 200. The window screen 200 may be of the type formed from a variety of materials such as, for example, aluminum, fiberglass, vinyl, copper/bronze, and other similar materials. While the disclosed decorative cover 100 is described for use on the window screen 200, it should be appreciated that the decorative cover 100 may be used to decorate and/or provided a safety indicator on a variety of other surfaces such as, for example, screens used in screened rooms, porches and/or enclosures, glass doors, and/or window and the like.

The decorative cover 100 can be positioned on the window screen 200 by a single person if the dimensions of the window screen are such that the person can reach the same desired point or area of installation 210 on the window screen 200 with both hands. If the window screen 200, or other desired surface, is too large to be reached by both hands or if the window screen is mounted in a window, then two people may be required to attach the magnetized first and second halves 110 and 112 of the decorative cover 100 from opposite sides, such as, for example, first and second sides 220 and 230, respectively, of the window screen 200.

A first person (not shown) positions and holds the first half 110 of the decorative cover 100 adjacent the first side 220 of the window screen 200 near the area of installation 210 and a second person (also not shown) positions and holds the second half 112 of the decorative cover 100 adjacent the second side 230 of the window screen 200. Once the first and second halves 110 and 112 are properly aligned at the area of installation 210 on the window screen 200, the first and second halves 110 and 112 are move sufficiently close enough that the positive polarity (+) of the first inner surface 114 of the first half 110 strongly attracts the negative polarity (−) of the second inner surface 116 of second half 112. The opposite polarities of the first and second inner surfaces 114 and 116, respectively, attract and hold each other with sufficient strength to clamp or "sandwich" the area of installation 210 of the window screen between them and thus hold the decorative cover 100 to the window screen 200 (FIG. 5).

In this manner, the decorative cover 100 is manufactured and used in such a manner that the decorative cover 100 can provide an esthetically pleasing decoration and/or safety device to a surface that would otherwise not support a magnetic decoration or safety device. Furthermore, the decorative cover 100 may be provided in a variety of sizes from decorative relatively small size to large privacy sizes. For example, when used in large outdoor screened in areas such as porches, pool and/or spa enclosures in high traffic areas such as golf courses, condo or townhouse developments or the like, the decorative magnet may be sized sufficiently large enough to block the view of outsiders and provide a significant degree of privacy for the user.

The large size decorative covers 100 may additionally be positioned at strategic locations on the subject screens to block views from specific directions or areas. Still further, multiple decorative covers 100 may be used together to provide the privacy function. Thus, the decorative covers 100 may be utilized as privacy enhancing devices while still maintaining a decorative appearance.

Figure 6A:
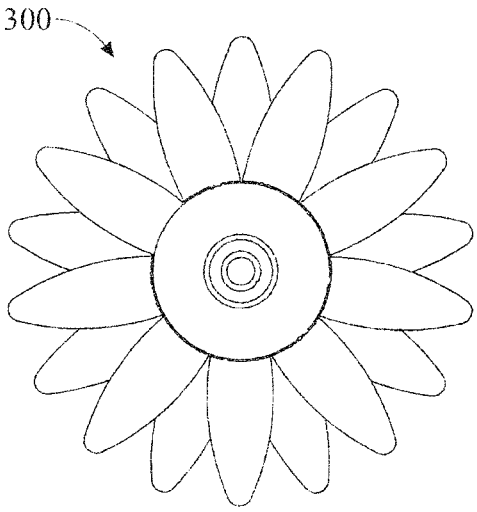
FIG. 6A presents a front plan view of an alternative embodiment of a decorative magnetic cover for use on a screen and depicting a flower.
Figure 6B:
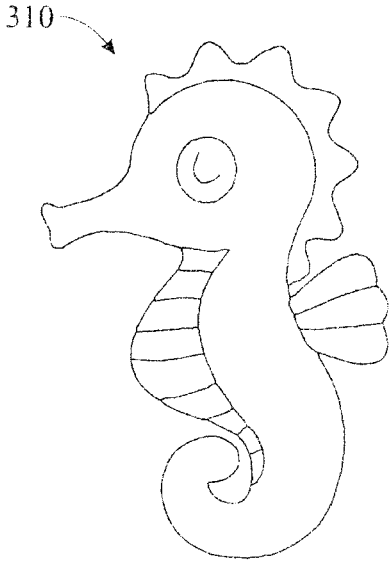
FIG. 6B presents a front plan view of another alternative embodiment of a decorative magnetic cover for use on a screen and depicting a fish.
Figure 6D:
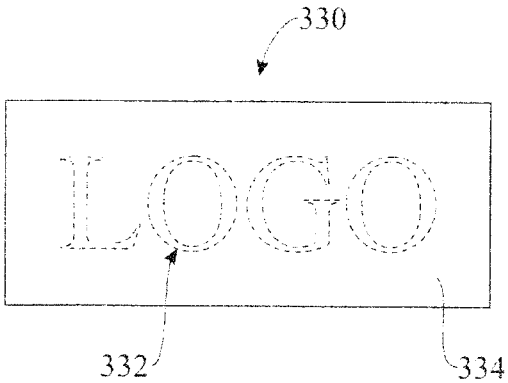
FIG. 6D presents a front plan view of a further alternative embodiment of a decorative magnetic cover for use on a screen and depicting a logo.
Figure 6C:
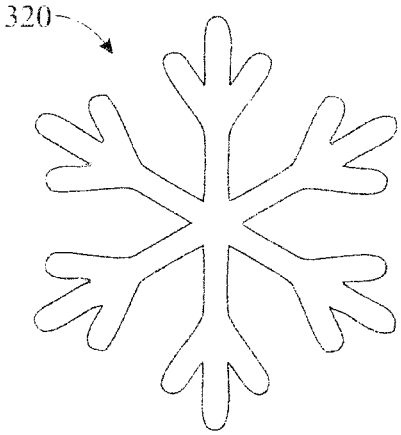
FIG. 6C presents a front plan view of a still further alternative embodiment of a decorative magnetic cover for use on a screen and depicting a snowflake.

Turning now to FIGS. 6A-D, there are disclosed alternative embodiments of the above described decorative cover 100. For example, FIG. 6A discloses a decorative magnetic cover 300 in the shape of a flower. FIG. 6B discloses a decorative magnetic cover 310 in the shape of a sea horse while FIG. 6C disclose a decorative magnetic cover 320 in the shape of a snowflake.

Unlike the purely esthetically pleasing decorations of FIGS. 6A-6C, FIG. 6D discloses a decorative magnetic cover 330 that provides information. For example, the decorative cover 330 includes a logo 332 formed on an outer surface 334 of the decorative cover 330. Other information may be provided in place of the logo 332, such as, for example, names, titles, numbers and/or symbols, etc. This can be useful when the decorative cover 330 is deployed in a public area such as, for example, a ballpark and the like.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A magnetic cover for application to opposed sides of a non-metallic surface, the magnetic cover comprising:

a magnetized first half having a first inner surface and a first outer surface, said first half being formed from a sheet of magnetic material such that said first inner surface has a first polarity and said first outer surface has a second polarity opposite said first polarity;

a magnetized second half having a second inner surface and a second outer surface, said second half being formed from a sheet of magnetic material such that said second inner surface of said second half has an opposite polarity from said first polarity of said first inner surface of said first half; and an imprint formed on at least one of said first and second outer surfaces of said first and second halves.

* * * * *